US005546716A

United States Patent [19]

Broxterman et al.

[11] Patent Number: 5,546,716

[45] Date of Patent: Aug. 20, 1996

[54] JOIST BRIDGE

[76] Inventors: Donald J. Broxterman, 3511 SW. Burlingame Rd., Topeka, Kans. 66611; Kevin M. Broxterman, 2207 SW. 7th St., Topeka, Kans. 66606

[21] Appl. No.: 279,044

[22] Filed: Jul. 22, 1994

[51] Int. Cl.[6] ..... E04C 2/52

[52] U.S. Cl. ..... 52/220.1; 52/693; 248/56; 248/57

[58] Field of Search ..... 52/693, 696, 713, 52/220.1, 317, 639; 248/56, 57, 49, 70

[56] References Cited

U.S. PATENT DOCUMENTS

| | | | |
|---|---|---|---|
| 2,965,342 | 12/1960 | Goldstone | 52/693 |
| 3,163,386 | 12/1969 | Collins | 52/693 |
| 3,925,948 | 12/1975 | Saver et al. | 52/696 X |
| 4,746,066 | 5/1988 | Kitchens | 52/220.1 X |
| 4,947,612 | 8/1990 | Taylor et al. | 52/693 |
| 5,230,190 | 7/1993 | Schuette | 52/220.1 |
| 5,325,651 | 7/1994 | Meyer et al. | 52/696 X |

*Primary Examiner*—Wynn E. Wood
*Assistant Examiner*—Beth A. Aubrey
*Attorney, Agent, or Firm*—Chase & Yakimo

[57] ABSTRACT

Bridging for joists that does not interfere with the installation of heat and air conditioning runs is provided by longitudinally spaced, transverse plate members which extend between the joists and have a span that may be varied to accommodate a particular joist spacing. Each of the plate members presents a major surface that is disposed in an upright plane, a central opening being provided through the surface for receiving a longitudinally extending conduit. The openings in the spaced plate members are aligned so that the conduit may be readily installed and supported by the plate members. The bridging, therefore, enhances the structural rigidity of the joists and supports the conduit in the space between the joists without interfering with installation of the conduit.

3 Claims, 1 Drawing Sheet

JOIST BRIDGE

BACKGROUND OF THE INVENTION

This invention relates to improvements in bridging for floor joists and, in particular, to a bridge member that accommodates variations in the spacing between joists and permits the installation of heat and air conditioning runs between the joists without sacrificing structural strength.

Wooden floor joists are commonly used in the construction of houses and similar structures as well as smaller commercial buildings. In order to increase the structural rigidity of the joists and prevent squeaky floors and other problems caused by unwanted vibration and shifting, it is common practice to install bridging between the joists to minimize vertical and lateral deflection. As the joists are typically arranged in parallelism on selected center-to-center spacing, such as 16 inches (40 centimeters), the bridging extends transversely between adjacent pairs of joists and spans the approximately 16-inch space between each pair of joists and is installed in rows spaced longitudinally of the joists. The bridging pattern thus established materially increases the structural rigidity of the floor system.

Bridging in common use may comprise wooden or steel cross braces that are nailed in place, each bracing member extending from the top of one joist to the bottom of an adjacent joist to form a cross configuration when two bridging members are installed. This blocks or severely restricts the longitudinal passageway between the joists and typically results in the omission of the bridging between those pairs of joists between which heating and air conditioning runs are to be installed. Typically, the installers of mechanical runs simply remove the bridging previously installed during the rough-in construction in order to expedite the implacing of conduits or duct work. This results in spaces in the floor system throughout the structure that are devoid of bridging and presents regions of structural weakness that are subject to unwanted deflection.

SUMMARY OF THE INVENTION

It is, therefore, the primary object of the present invention to provide bridging for joists that does not interfere with the installation of heat and air conditioning runs, wherein the bridging has generally horizontally aligned openings therethrough for receiving a conduit and thereby supports the conduit in the space between the joists while also functioning in the usual manner to brace the joists against deflection.

As a corollary to the foregoing object, it is an important aim of this invention to provide a supporting bridge for joists that employs a transverse plate member extending between the joists which presents a major surface disposed substantially in an upright plane, wherein an opening is provided through the surface for receiving a conduit extending longitudinally of the joists to support the conduit in the space between the joists.

Another important object of this invention is to provide bridging for joists comprising transverse plate members as aforesaid rather than cross braces as employed heretofore, wherein the members are spaced longitudinally along the joists and the openings therein are aligned to receive a longitudinally extending conduit to support the conduit in the space between the joists.

Still another important object of the invention is to provide a plate member that is utilized as a structural bridge between adjacent joists and which has a span that may be varied to accommodate the space between the joists, the ends of which may be readily secured to corresponding joists.

In furtherance of the preceding object, it is also an objective of this invention to provide such a plate member that includes adjustable components at its ends moveable in directions to vary the span of the member and hence accommodate variations in joist spacing.

Other objects will become apparent as the detailed description proceeds.

DETAILED DESCRIPTION

Figure 1:
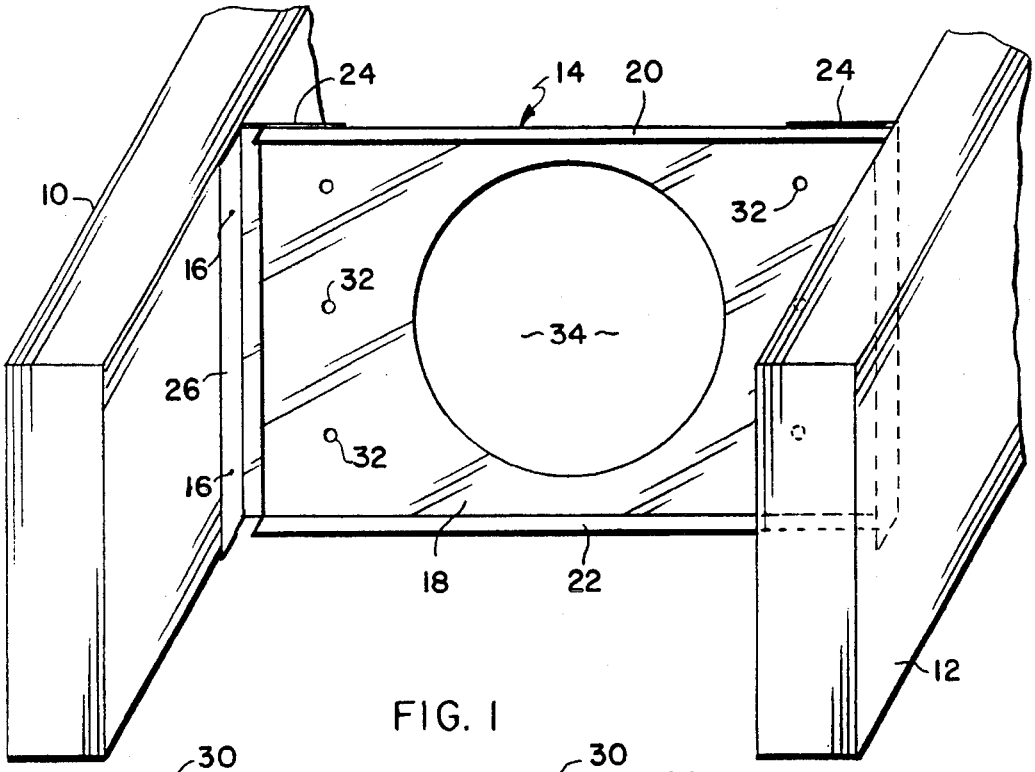
FIG. 1 is a fragmentary, perspective view of the end portions of a pair of adjacent joists, the bridge of the present invention being shown installed therebetween.

Referring initially to FIG. 1, a pair of spaced, elongated, side-by-side joists 10 and 12 are shown fragmentarily, it being appreciated that the joists 10 and 12 are part of a conventional floor system employing a number of such joists and, typically, an overlying subfloor and finished flooring (not shown). A rectangular metal plate 14 presents the bridge member of the present invention and is shown extending transversely between the joists 10 and 12 and installed by attachment of the ends thereof to joists 10 and 12 by nails 16 or other suitable fasteners. Two nails 16 are shown in FIG. 1 securing the left end of plate member 14 to joist 10 at its inner surface, it being understood that a like attachment is made at the other end to joist 12 but is hidden from view. The plate 14 has a main component 18 which is rectangular but of a length less than the minimum spacing expected between the joists 10 and 12. By way of example, FIG. 1 may be considered as depicting a pair of 2×8 joists spaced apart on 16-inch centers, in which case the length of main component 18 would be less than the minimum spacing between the joists after allowance for the usual tolerances in floor construction.

Figure 2:
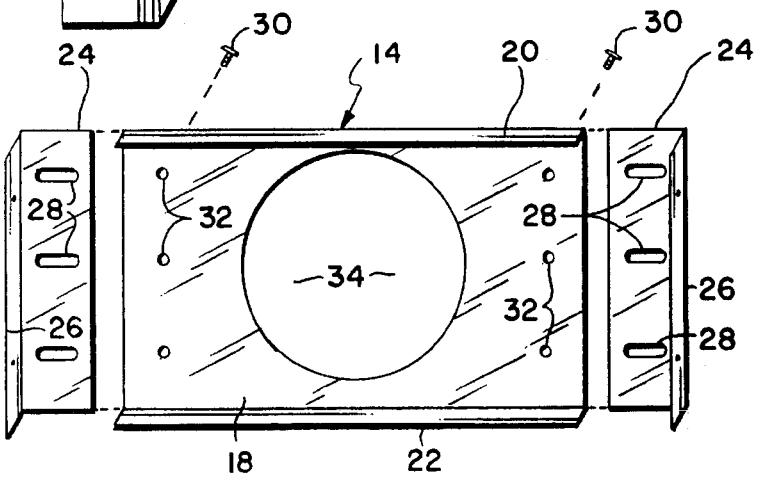
FIG. 2 is a frontal, perspective, exploded view of the bridge member alone on a reduced scale as compared to FIG. 1, showing the adjustable end components for varying the span of the bridge member.

As may be seen in FIGS. 1 and 2, the upper and lower, longitudinal edges of the main plate component 18 are bent over at approximately right angles to present upper and lower lips 20 and 22. A pair of adjustable plate components 24 present the ends 26 of plate member 14. Each of the adjustable components 24 has three vertically spaced, slotted openings 28 therein to permit the overall length or span of member 14 to be adjusted to accommodate the spacing of the joists 10 and 12, plate components 24 being held flush against the rear surface of main component 18 by sheet metal screws 30 which extend through corresponding slots 28 and are received by openings 32 in main component 18. Each of the ends 26 is presented by a right-angle bend in component 24, thereby presenting an attachment surface parallel to the joist which is flush thereagainst when nails 16 are in place.

Figure 3:
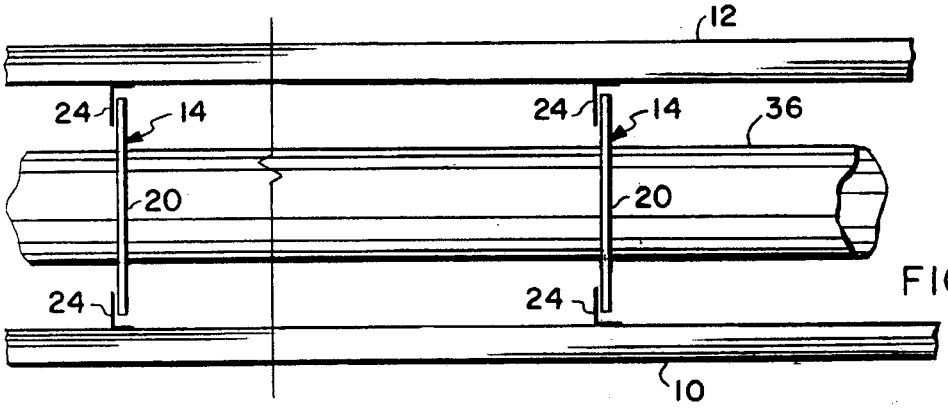
FIG. 3 is a fragmentary, plan view on a further reduced scale showing a conduit supported by the bridging of the present invention in the space between adjacent joists.

The main component 18 of the plate member 14 presents a major surface which is disposed in an upright plane when the bridge is installed, such surface having a relatively large, circular central opening 34 therethrough for receiving a conduit 36 as illustrated in FIG. 3 where two bridge members 14 are shown spaced longitudinally along the joists 10 and 12. Conduit 36 may, for example, comprise a galvanized metal heat pipe through which hot or cold air flows in response to the operation of a heating and air conditioning system (not shown). Since the bridge members 14 do not interfere with the installation of conduit 36 and actually serve as a support therefor, the advantage of the use of bridging between the joists is not sacrificed along heating and air conditioning runs.

In use, conventional cross-brace bridging may be used between joists that will not contain mechanical runs, while the bridges of the present invention are utilized with those joists between which mechanical runs will be installed. When the runs are laid, sections of conduit 36 are simply threaded through the horizontally aligned openings 34 and joined in the usual manner. The present invention, therefore, eliminates the practice of removing and discarding the bridging that impedes the installation of conduits or duct work. The diameter of the openings 34 is selected to accommodate the conduit size specified for the building under construction.

Having thus described the invention, what is claimed as new and desired to be secured by Letters Patent is:

1. In combination with a pair of spaced, elongated, side-by-side joists, each of said joists having an upper longitudinal surface:

a transverse plate member extending between said joists and located entirely below said upper surfaces, said member having a pair of spaced ends and presenting a major surface between said ends disposed substantially in an upright plane, said member including a pair of plate components presenting the respective ends thereof, at least one of which is movable in directions to vary the span of the member to accommodate the space between said joists, means for securing said one component in a selected position, whereby the span of the member is set to accommodate the joist spacing, means for securing said ends of the member to corresponding joists below said upper surfaces, and said member having an opening through said major surface thereof for receiving a conduit extending longitudinally of the joists to support the conduit in the space between the joists, whereby to provide a supporting bridge that permits the installation of heat runs and the like between the joists.

2. The combination as claimed in claim 1, wherein each of said components is of angular configuration to present an end surface parallel to the corresponding joist for securement of the plate member thereto.

3. The combination as claimed in claim 1, wherein said opening is centrally disposed with respect to said ends of the member.

* * * * *